US012319479B2

(12) United States Patent
Donegan

(10) Patent No.: US 12,319,479 B2
(45) Date of Patent: Jun. 3, 2025

(54) ONE-PIECE CARTON WITH HANG TAB

(71) Applicant: Menasha Corporation, Neenah, WI (US)

(72) Inventor: Michael P. Donegan, Cherry Hill, NJ (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 18/103,248

(22) Filed: Jan. 30, 2023

(65) Prior Publication Data

US 2023/0249871 A1 Aug. 10, 2023

Related U.S. Application Data

(60) Provisional application No. 63/308,272, filed on Feb. 9, 2022.

(51) Int. Cl.
*B65D 5/42* (2006.01)
*B65D 5/02* (2006.01)
*B65D 5/20* (2006.01)

(52) U.S. Cl.
CPC ..... *B65D 5/4208* (2013.01); *B65D 5/0227* (2013.01); *B65D 5/2076* (2013.01)

(58) Field of Classification Search
CPC .. B65D 5/4208; B65D 5/0227; B65D 5/4612; B65D 5/46128
USPC ..... 229/117.09, 117.14, 117.18
See application file for complete search history.

(56) References Cited

U.S. PATENT DOCUMENTS 2,074,638 A * 3/1937 Black ..... B65D 5/46128 229/117.14
3,946,936 A * 3/1976 Brown ..... B65D 5/4208 229/117.18
5,379,894 A * 1/1995 Haas ..... B65D 5/4208 206/461
6,155,479 A * 12/2000 Wellner ..... B65D 5/2047 229/117.15
9,150,327 B2 * 10/2015 Begim ..... B65D 5/4204
2011/0297738 A1 * 12/2011 Hsiao ..... B65D 5/4208 229/117.09

FOREIGN PATENT DOCUMENTS

GB 2204022 A * 11/1988 ..... B65D 5/0254
WO WO-0238453 A1 * 5/2002 ..... B65D 5/3685

* cited by examiner

*Primary Examiner* — Nathan J Newhouse
*Assistant Examiner* — Phillip D Schmidt
(74) *Attorney, Agent, or Firm* — UB Greensfelder LLP; Richard C. Himelhoch

(57) ABSTRACT

A one-piece carton with a strong hang tab includes a back wall, a bottom wall, a front wall, a top wall. A tab is formed from a first tab portion and a second tab portion to provide a tab having two layers of material. The tab can extend upward from the back wall of the container or from a mid-portion of the top wall. Flaps are provided on either side of the back wall, bottom wall, front wall and top wall to form side walls for the carton. The carton is formed from a blank of paperboard or corrugated paper or similar material.

12 Claims, 8 Drawing Sheets

ONE-PIECE CARTON WITH HANG TAB

CROSS-REFERENCE TO RELATED APPLICATIONS

The present invention claims priority to and the benefit of U.S. Provisional Patent Application No. 63/308,272 filed Feb. 9, 2022, the contents of which are incorporated herein by reference and made a part hereof.

FEDERALLY SPONSORED RESEARCH OR DEVELOPMENT

N/A

FIELD OF THE INVENTION

The present invention is generally directed to a hanging carton having a strong hang tab structure, and more particularly, to a carton having a hang tab formed from a first layer of material and a second layer of material.

DESCRIPTION OF THE PRIOR ART

There are a large number of cartons on the market that are configured to hang on a display at a retail location. Many of these cartons include tabs that can be secured to hooks on the display.

There are a number of options for forming the tab. In some instances, the tab is integrally formed from the same blank of material forming the carton, and is a single layer of that material. In other instances, the tab is formed from a separate, same-material piece, or a separate attaching tab of a different material such as plastic.

The present invention provides a one-piece carton with a strong tab structure to support heavy objects in the carton without the need for a plastic clamshell structure.

SUMMARY OF THE INVENTION

The present invention is generally directed to a one-piece carton with hang tab having enhanced strength over prior cartons. The hang tab is configured to hold a fully loaded, heavy carton from a hook on a display without tearing or breaking.

In accordance with one aspect of the invention, a carton with a strong hang tab comprises a back wall formed from a single layer of material, a bottom wall formed from a single layer of material connected to a lower edge of the back wall, a front wall formed from a single layer of material connected at a bottom edge to the bottom wall and a top wall formed from a single layer of material connected to a top edge of the front wall and a top edge of the back wall. A first side wall is provided on a first side of the back wall, bottom wall, front wall and top wall, and a second side wall is provided on a second side of the back wall, bottom wall, front wall and top wall. A first hang tab portion formed from a single layer of material extends upward from the carton and a second hang tab portion formed from a single layer of material extends upward from the carton adjacent the first hang tab. The first hang tag portion and the second hang tag portion form a double layer of material extending from the carton.

The first hang tab portion includes a centrally located opening, and the second hang tab portion includes a centrally located opening. The openings allow the hang tab to be secured to a hook on a display.

The first hang tab portion is glued to the second hang tab portion. Preferably, the glue is applied below the opening on the first hang tab portion and below the opening on the second hang tab portion. Additionally, the glue is also applied above the opening on the first hang tab portion and above the opening on the second hang tab portion.

The first hang tab portion and the second hang tab portion can extend upward proximate the back wall. In this instance, the first hang tab portion can be connected to a top edge of the back wall and the second hang tab portion can be connected to a back edge of the top wall.

Alternatively, the first hang tab portion and the second hang tab portion can extend upward from a middle portion of the top wall. In this case, the top wall can be configured to have a first top wall portion and a second top wall portion. Each top wall portion can include one of the first hang tab portion and the second hang tab portion.

The first side wall can be formed from flaps extending from a first side of the back wall, bottom wall, front wall and top wall. Similarly, the second side wall can be formed from flaps extending from a second side of the back wall, bottom wall, front wall and top wall.

The back wall, bottom wall, front wall, top wall, first side wall, second side wall, first hang tab portion, and second hang tab portion can be formed from a single blank of material. The material can be paperboard, corrugated paper, or other similar or suitable materials.

The centrally located opening in the first hang tab can have a generally rectangular portion and an arcuate portion extending upward from a middle of the rectangular portion. Similarly, the centrally located opening in the second hang tab can have a generally rectangular portion and an arcuate portion extending upward from a middle of the rectangular portion.

In accordance with another aspect of the invention, a carton with a strong hang tab comprises a container for holding a product and a hang tab extending upward from the container. The hang tab is formed from a first layer of material having a first opening and a second layer of material having a second opening aligned with the first opening. The first layer of material is glued to the second layer of material at a first position below the first opening and second opening and at a second position above the first opening and second opening. The container and hang tab are formed from a single blank of paper material, such as paperboard or a corrugated paper.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings in which.

DETAILED DESCRIPTION

Figure 1:
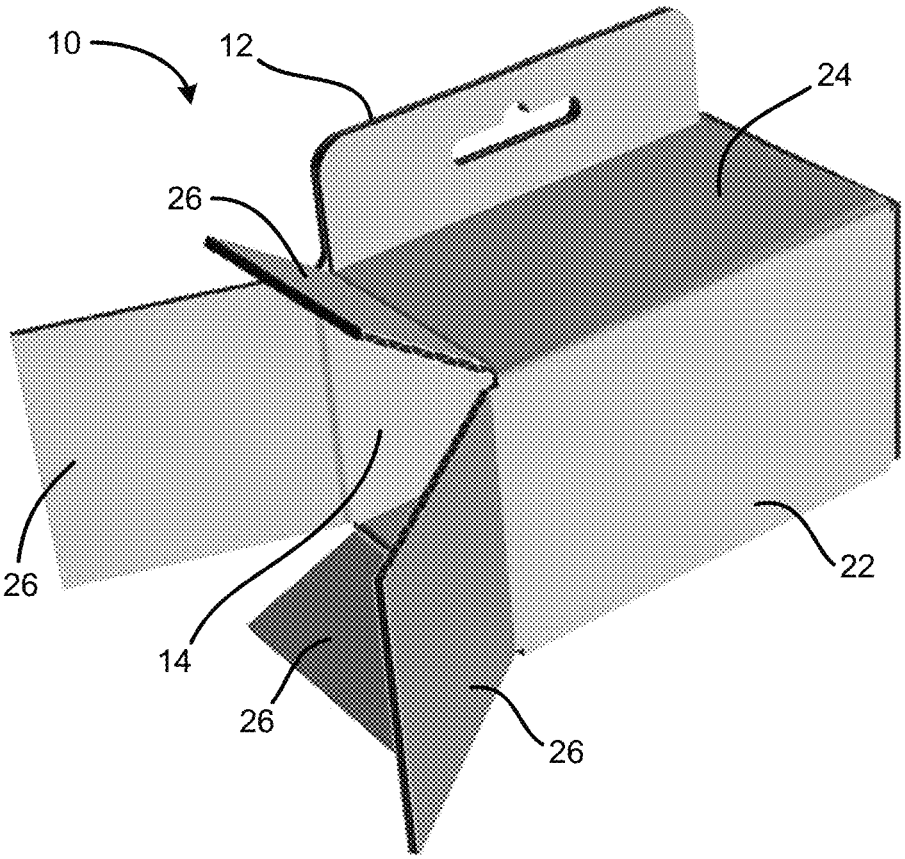
FIG. 1 is a perspective view of a carton with a strong hang tab extending from a back wall of the carton in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a carton for use in a retail display. The carton includes a strong hang tab for securing the carton to a hook on the display. The hang tab is formed from two layers of material glued together to provide extra strength.

Figure 3:
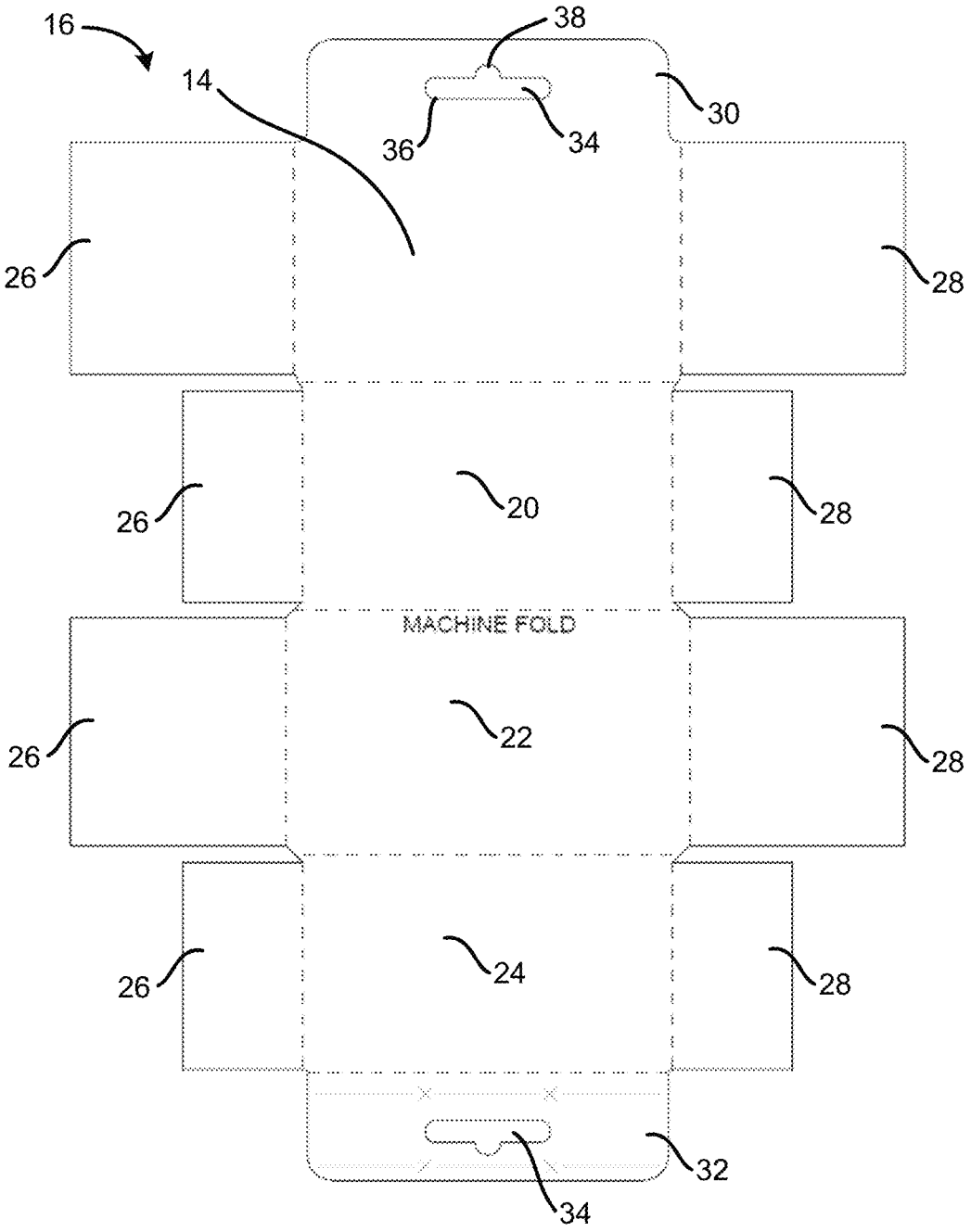
FIG. 3 is a top plan view of a first blank for forming a carton with a strong hang tab extending upward from a back wall of the carton.
Figure 4:
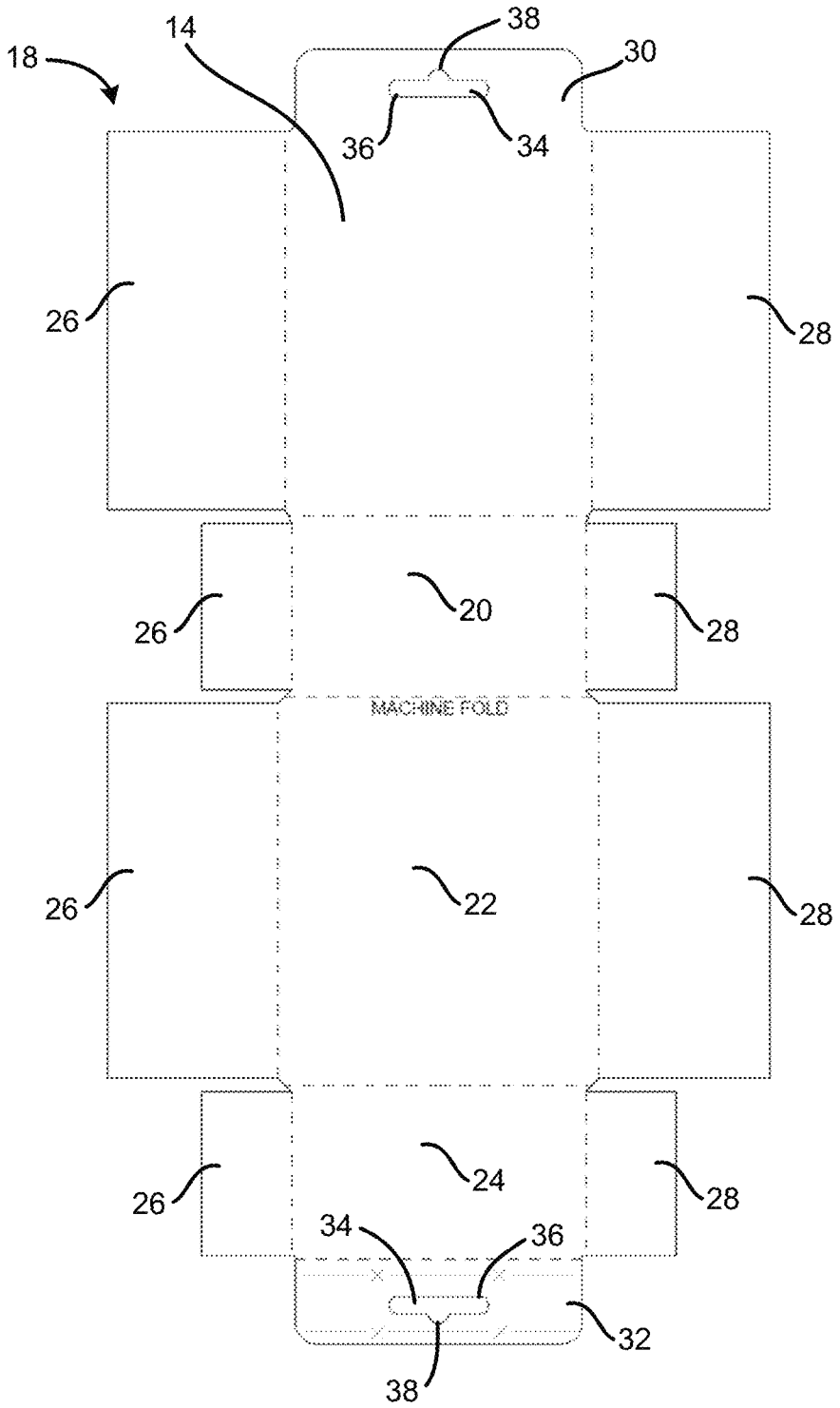
FIG. 4 is a top plan view of a second blank for forming a carton with a strong hang tab extending upward from a back wall of the carton.
Figure 5:
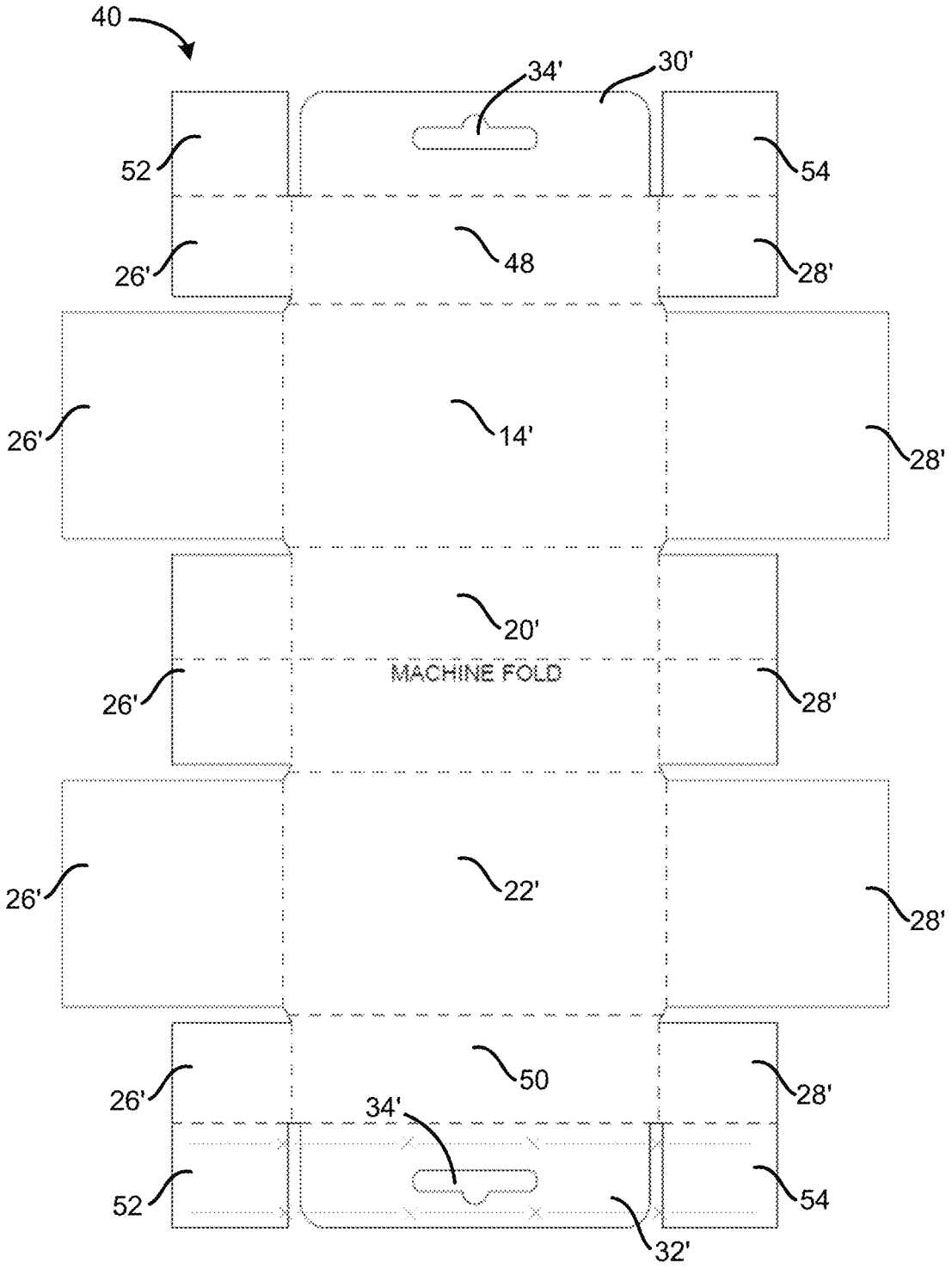
FIG. 5 is a top plan view of a first blank for forming a carton with a strong hang tab extending upward from a mid-portion of a top wall of the carton.
Figure 6:
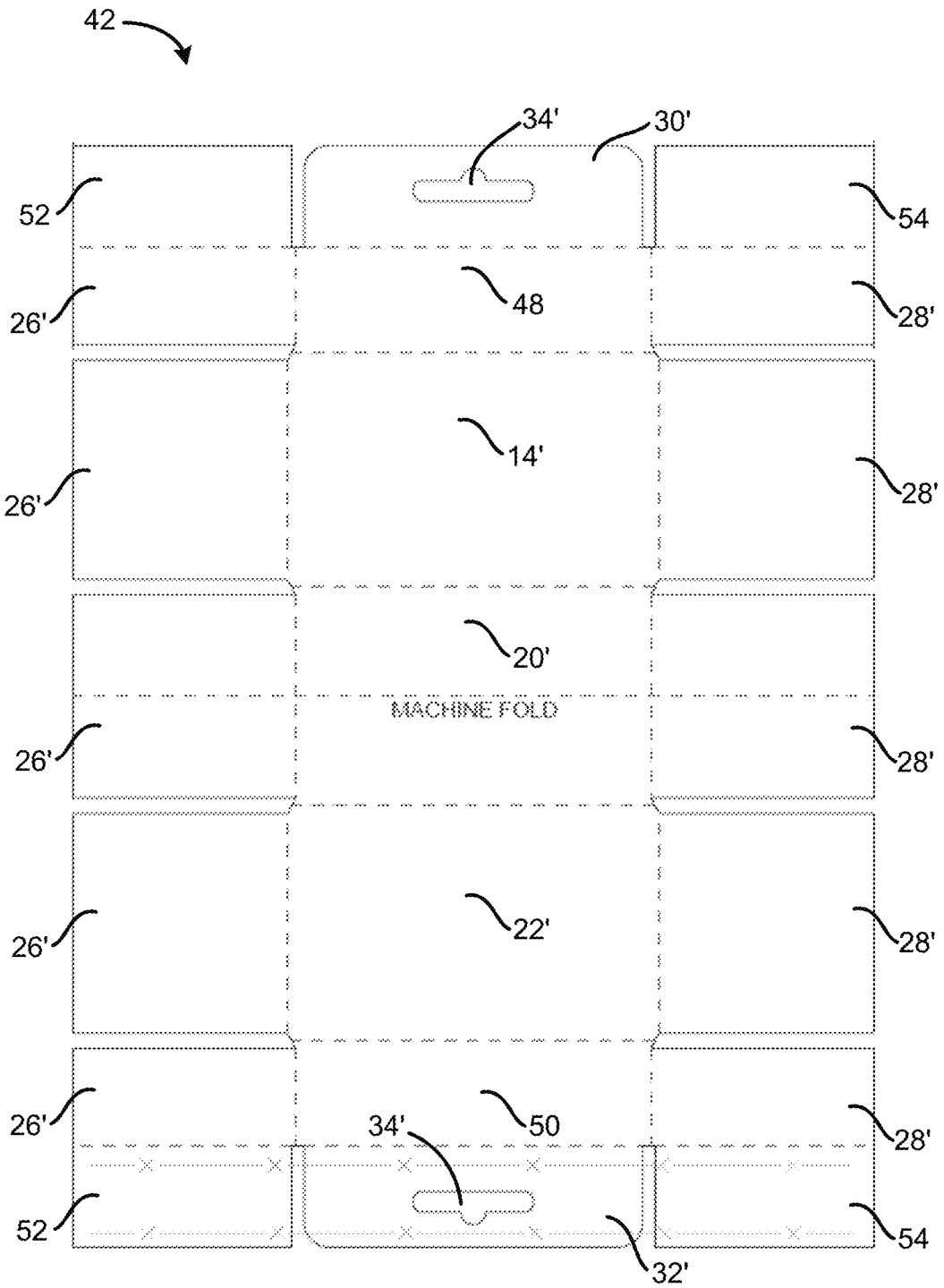
FIG. 6 is a top plan view of a second blank for forming a carton with a strong hang tab extending upward from a mid-portion of a top wall of the carton.
Figure 7:
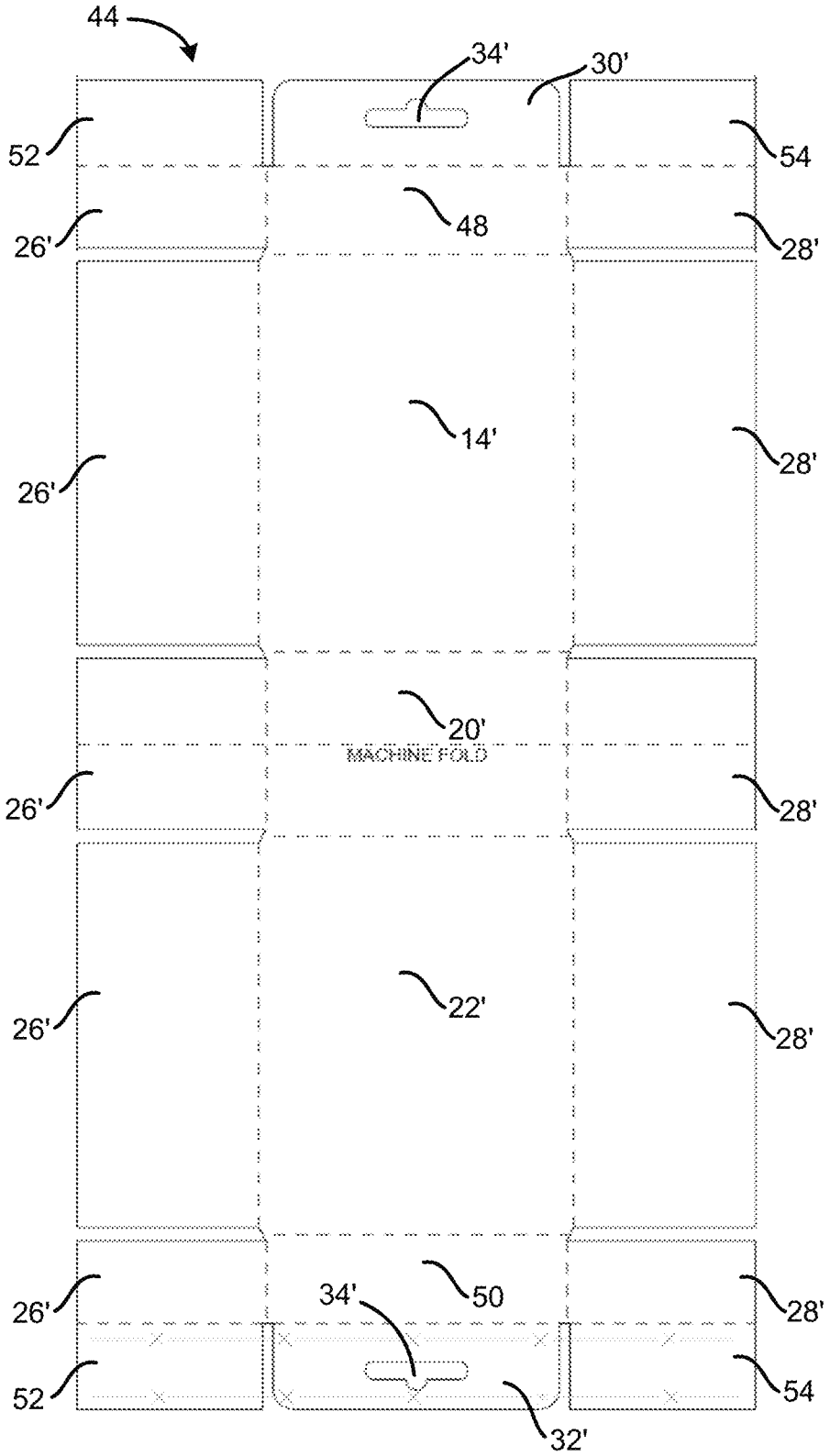
FIG. 7 is a top plan view of a third blank for forming a carton with a strong hang tab extending upward from a mid-portion of a top wall of the carton; and, FIG. 8 is a top plan view of a fourth blank for forming a carton with a strong hang tab extending upward from a mid-portion of a top wall of the carton.
Figure 8:
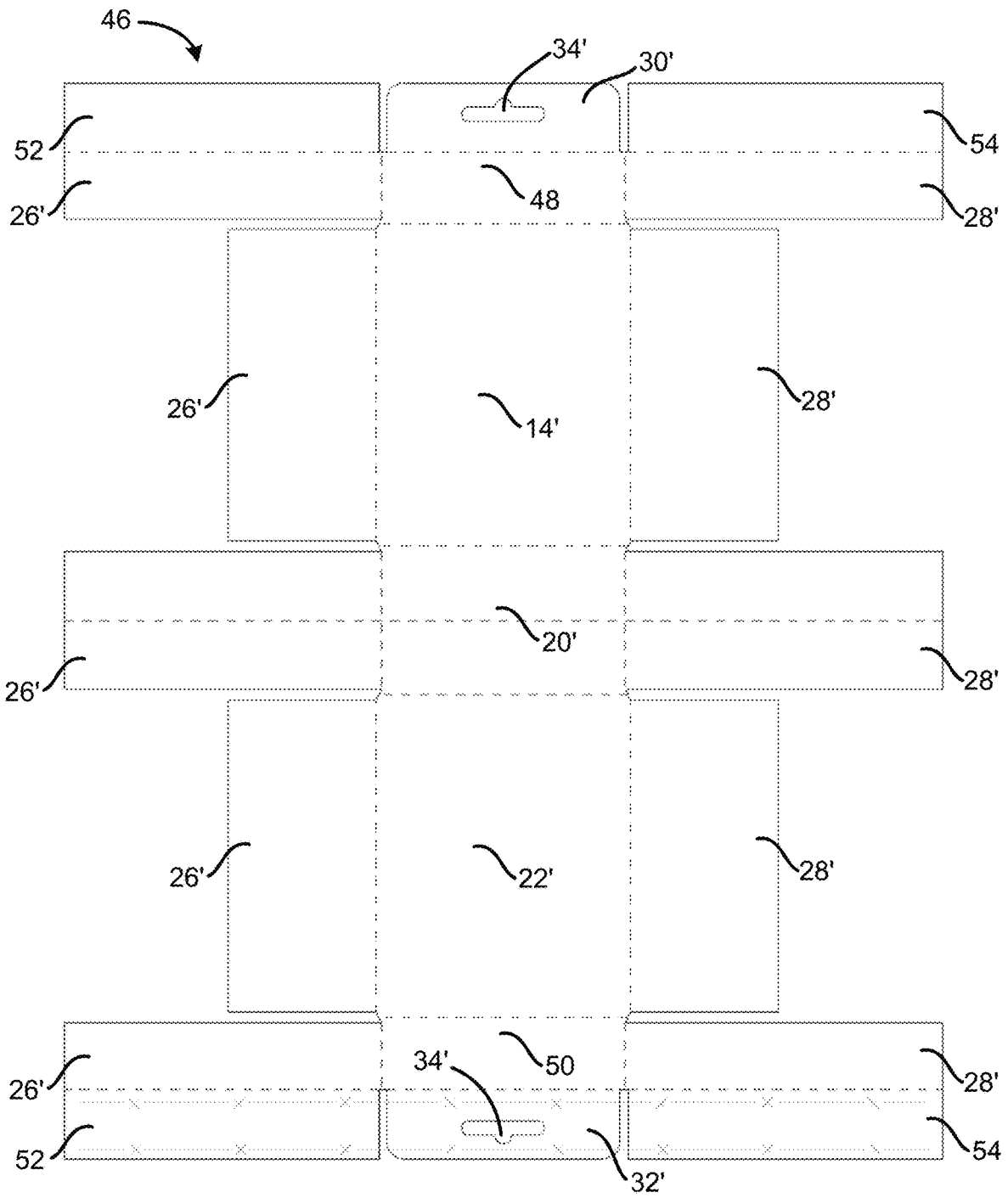

FIG. 1 shows a carton 10 in accordance with the present invention, having a strong hang tab 12 extending from a back wall 14 of the carton 10. A first blank 16 of material for forming a carton 10 having a hang tab 12 extending from a back wall 14 is shown in FIG. 3, and a second blank 18 for forming a carton 10 having a hang tab 12 extending from a back wall 14 is shown in FIG. 4. Other than the dimensions of the various walls, the cartons formed from each blank 16, 18 are structurally similar (and the same reference number will be used for like structures). The blanks 16, 18 are formed from a single layer of material, such as paperboard or a corrugated paper, and are cut to a desired shape. Fold lines are shown as dashed lines in the blanks 16, 18, and glue lines are shown having an "x" in the line.

Referring to like structures in FIG. 1 and FIGS. 3-4, the carton 10 includes a bottom wall 20 connected on a first side to a bottom edge of the back wall 14, a front wall 22 connected on a bottom edge to a second side of the bottom wall 20, and a top wall 24 connected to a top edge of the front wall 22. Each of the back wall 14, bottom wall 20, front wall 22 and top wall 24 includes a first flap 26 extending outward from a first side, and a second flap 28 extending outward from a second side. The first flaps 26 are foldable to form a first side wall for the carton 10, and the second flaps 28 are foldable to form a second side wall of the carton 10.

A first tab portion 30 formed from a single layer of the blank material extends upward from a top edge of the back wall 14. A second tab portion 32 formed from a single layer of the blank extends from a fold line from the top wall 24. When folded into the carton structure, the first tab portion 30 mates with the second tab portion 32 to form the tab 12 shown in FIG. 1. Glue can be applied to one or both of the tab portions 30, 32 to secure them together. The combined portions 30, 32 provide a strong tab 12 having two layers of material.

Each of the tap portions 30, 32 include a central opening 34. The central opening 34 includes a generally elongated rectangular portion 36 and an arcuate portion 38 extending upward (when the carton 10 is constructed) in a mid-portion of the rectangular portion 36. The opening 34 allows the tab 12 to be placed on a hook in a display. Preferably, glue is applied both above and below the opening 34 to secure the first tab portion 30 to the second tab portion 32.

Figure 2:
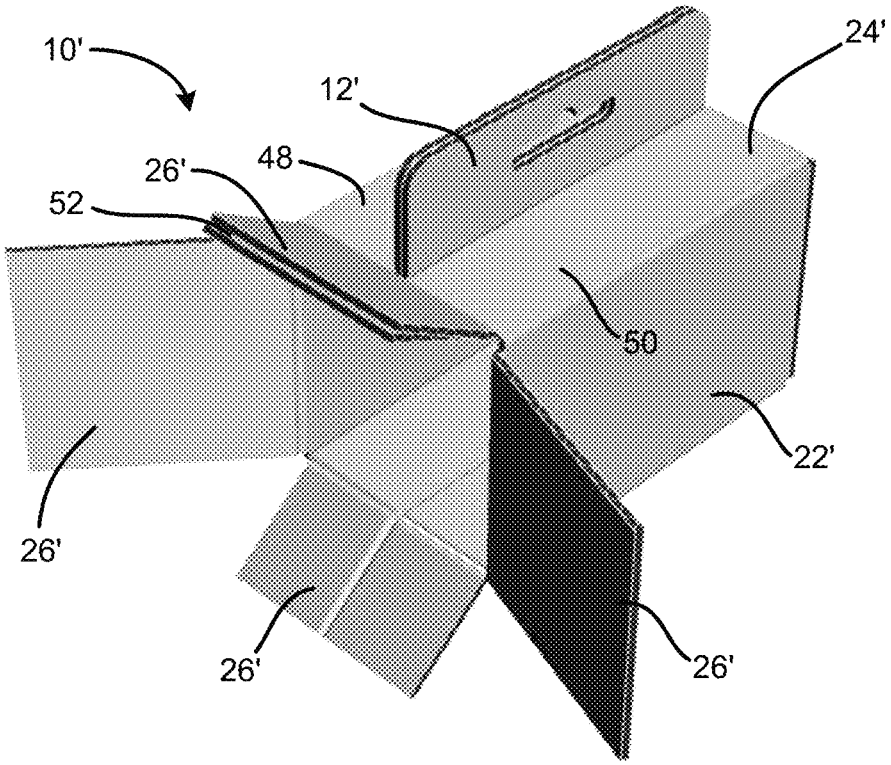
FIG. 2 is a perspective view of a carton with a strong hang tab extending from a mid-portion of a top wall of the carton in accordance with the present invention.

FIGS. 2 and 5-8 show another carton 10' in accordance with the present invention, having a tab 12' extending upward from a center or mid-portion of the top wall 24'. FIG. 2 shows a constructed carton 10' and FIGS. 5-8 show blanks 40, 42, 44, 46 for forming a carton 10'. Similar to the tab 12 of carton 10, tab 12' is also formed having two layers of material from the blank.

Referring to like structures in FIG. 2 and the blanks 40, 42, 44, 46 of FIGS. 5-8, the carton 10' includes a back wall 14', a bottom wall 20', and a front wall 22'. The carton 10' also includes a top wall 24' formed from a first top wall portion 48 and a second top wall portion 50. The first top wall portion 48 is connected by a fold line to a first tab portion 30' and the second top wall portion 50 is connected by a fold line to a second tab portion 32'. The carton 10' also includes flaps 26' and 28' extending from the sides of the back wall 14', bottom wall 20', front wall 22' and both parts 48, 50 of the top wall 24' to form side walls in the carton 10'.

When the carton 10' is formed, the first tab portion 30' is glued to the second tab portion 32'. By connecting the first tab portion 30' to the first top wall portion 48 and the second tab portion 32' to the second top wall portion 50, the tab 12' is positioned in the center or mid-portion of the top wall 24'.

As shown in the blanks 40, 42, 44, 46, the flaps 26', 28' extending from the first top wall portion 48 and the second top wall portion 50 include an extended portion 52, 54 that are glued to form a wider flap.

Many modifications and variations of the present invention are possible in light of the above teachings. It is, therefore, to be understood within the scope of the appended claims the invention may be protected otherwise than as specifically described.

I claim:

1. A carton with a strong hang tab comprising:

a back wall formed from a single layer of material, a bottom wall formed from a single layer of material connected to a lower edge of the back wall;

a front wall formed from a single layer of material connected at a bottom edge to the bottom wall;

a top wall formed from a single layer of material having a first top portion connected to a top edge of the front wall and a second top portion connected to a top edge of the back wall, wherein the first top portion includes a first side flap extending from a first side of the first top portion and a second side flap extending from a second side of the first top portion, and the second top portion includes a first side flap extending from a first side of the second top portion and a second side flap extending from a second side of the second top portion;

a first side wall on a first side of the back wall, bottom wall, front wall and top wall;

a second side wall on a second side of the back wall, bottom wall, front wall and top wall;

a first hang tab portion formed from a single layer of material extending upward from the carton; and, a second hang tab portion formed from a single layer of material extending upward from the carton adjacent the first hang tab wherein the first hang tag portion and the second hang tag portion form a double layer of material extending from the carton:

wherein the back wall, bottom wall, front wall, top wall, first side wall, second side wall, first hang tab portion, and second hang tab portion are formed from a single blank of material and wherein the first hang tab portion is at a first end of the blank and the second tab portion is at an opposing second end of the blank and wherein the first hang tab portion and the second hang tab portion extend upward from a middle portion of the top wall, and wherein the first hang tab portion includes a centrally located opening, and the second hang tab portion includes a centrally located opening, and the first hang tab portion is glued to the second hang tab portion.

2. The carton of claim 1 wherein the glue is applied below the opening on the first hang tab portion and below the opening on the second hang tab portion.

3. The carton of claim 2 wherein the glue is applied above the opening on the first hang tab portion and above the opening on the second hang tab portion.

4. The carton of claim 1 wherein the first side wall is formed from flaps extending from a first side of the back wall, bottom wall, front wall and top wall.

5. The carton of claim 4 wherein the second side wall is formed from flaps extending from a second side of the back wall, bottom wall, front wall and top wall.

6. The carton of claim 1 wherein the first side flap of the first top portion includes a first portion and as second portion foldably connected to the first portion to provide the first side flap with a double thickness.

7. The carton of claim 6 wherein the first hang tab is connected to the first top portion.

8. The carton of claim 7 wherein the second hang tab is connected to the second top portion.

9. The carton of claim 1 wherein the blank is formed from paperboard.

10. The carton of claim 1 wherein the blank is formed from a corrugated paper.

11. The carton of claim 1 wherein the centrally located opening in the first hang tab has a generally rectangular portion and an arcuate portion extending upward from a middle of the rectangular portion.

12. The carton of claim 11 wherein the centrally located opening in the second hang tab has a generally rectangular portion and an arcuate portion extending upward from a middle of the rectangular portion.

* * * * *